United States Patent [19]

Reynolds

[11] Patent Number: 5,025,692

[45] Date of Patent: Jun. 25, 1991

[54] CUTTER FOR WALL COVERING SHEET ROLLS

[76] Inventor: Doug J. Reynolds, 17055 Valley Ave., Pierrefonds, Quebec, Canada, H9J 1G4

[21] Appl. No.: 451,941

[22] Filed: Dec. 18, 1989

Related U.S. Application Data

[63] Continuation-in-part of Ser. No. 173,150, Mar. 25, 1988, abandoned.

[51] Int. Cl.[5] ..... B26D 7/01

[52] U.S. Cl. ..... 83/468; 83/408; 83/468.7; 83/522.19; 83/614; 83/649

[58] Field of Search ..... 83/614, 649, 455, 44, 83/408, 467.1, 468, 468.7, 485, 522.18, 522.19

[56] References Cited

U.S. PATENT DOCUMENTS

| | | | |
|---|---|---|---|
| 2,595,500 | 5/1952 | Zimmerman | 83/468 |
| 2,645,543 | 7/1953 | Mancini | 83/649 |
| 3,142,217 | 7/1964 | Busse | 83/614 |
| 3,277,760 | 10/1966 | Keene et al. | 83/455 |
| 3,296,911 | 1/1967 | McLane | 83/408 |
| 3,358,540 | 12/1967 | Hall | 83/455 |
| 3,688,625 | 9/1972 | Thomas et al. | 83/614 |
| 3,752,025 | 8/1973 | Van Everdingen | 83/485 |
| 3,779,119 | 12/1973 | Broides | 83/468 X |
| 4,196,647 | 4/1980 | Fish | 83/175 |
| 4,351,208 | 9/1982 | Cobleigh et al. | 83/167 |
| 4,417,495 | 11/1983 | Gordon et al. | 83/175 |

FOREIGN PATENT DOCUMENTS

| | | | |
|---|---|---|---|
| 2758563 | 7/1979 | Fed. Rep. of Germany | 83/649 |

*Primary Examiner*—Frank T. Yost
*Assistant Examiner*—Eugenia A. Jones
*Attorney, Agent, or Firm*—Shlesinger, Arkwright & Garvey

[57] ABSTRACT

An apparatus for cutting wall covering sheet from a roll permits longitudinal as well as transverse cutting of sheet from a roll. The apparatus comprises a support to hold a roll of wall covering sheet and allow the sheet to be unwound, a transverse member on the support positioned substantially parallel with the roll, the sheet passing over the transverse member when unwound from the roll, the transverse member having a slot to enable a cutting blade to make a transverse cut in the sheet, a longitudinal track on the support extending transversely substantially parallel to the roll and the transverse member, a cutting blade holder slidingly mounted on the track for positioning at any location on the track, and a cutting blade to fit in the cutting blade holder to cut the sheet longitudinally as the sheet is unwound from the roll over the transverse member.

11 Claims, 3 Drawing Sheets

CUTTER FOR WALL COVERING SHEET ROLLS

This is a continuation-in-part of my application bearing Ser. No. 173,150 and filed on Mar. 25, 1988 and now abandoned.

The present application relates to cutting lengths and widths of wallpaper or vinyl wall coverings in rolls. More specifically, the present invention relates to an apparatus for cutting wall covering sheet transversely and longitudinally from a roll.

Wallpaper and other types of wall coverings are generally provided in rolls and wallpaper sheets are cut to a desired length simply by tearing the paper against a straight edge. This became somewhat harder when vinyl wall coverings replaced wallpaper as it became necessary to cut a sheet rather than tear same against a straight edge. There are various types of cutters available for wall coverings, however, most of these cut the sheet transversely from a roll at a desired length only. If one has to make a longitudinal cut in the sheet, then this is generally done by first cutting the correct length of sheet from a roll and then making a longitudinal cut in the cut sheet.

The present invention provides a novel cutting apparatus which allows a predetermined length of sheet to be transversely cut from a roll and also allows a cut to be made longitudinally in the sheet as it is pulled from a roll.

The present invention provides an apparatus for cutting wall covering sheet transversely and longitudinally from a roll, said apparatus comprising:

a container having a rod positioned in slots on opposing inside ends of the container, the rod to hold a roll of wall covering sheet and allow the sheet to be unwound;

a cutting blade;

a transverse member on an edge of one side of the container positioned substantially parallel with the roll, the sheet passing over the transverse member when unwound from the roll, the transverse member having a slot therein extending along a longitudinal axis thereof, said slot constituting a guide for said cutting blade to make a transverse cut in the sheet;

a longitudinal track member in the container supported on the opposing inside ends of the container, and extending transversely substantially parallel to the roll and the transverse member, and disposed therebetween, the longitudinal track member providing a guide to deflect the sheet downwards for the sheet to pass thereunder when unwound from the roll and passing over the transverse member; and a cutting blade holder slidingly mounted on the track for positioning at any location on the track, said cutting blade being mounted in said cutting blade holder to cut the sheet longitudinally after passing under the longitudinal track member, and before passing over the transverse member, the said cutting blade being removable from said cutting blade holder and constituting means for making said transverse cut in said sheet by sliding engagement of said blade in the slot of said transverse member.

In other embodiments, the support is preferably a foldable cardboard container and the roll is supported on a rod positioned in slots in the container. The transverse member is preferably an H-shaped double slotted plastic extrusion, one slot fitting over one side of the cardboard container and the other slot for the cutting blade. In a preferred embodiment, a clip member is provided for moving along the transverse member to act as a guide for an edge of sheet unwound from the roll. In another embodiment, a scale on the container enables one to measure the location of the cutting blade holder on the track.

In yet other embodiments, the transverse member comprises a fixed tab adjacent one end of said transverse member, said transverse member being integrally moveable laterally along the said edge of the container so that the fixed tab thereof acts as a guide for an edge of sheet unwound from the roll.

In drawings which illustrate embodiments of the invention,

Figure 1:
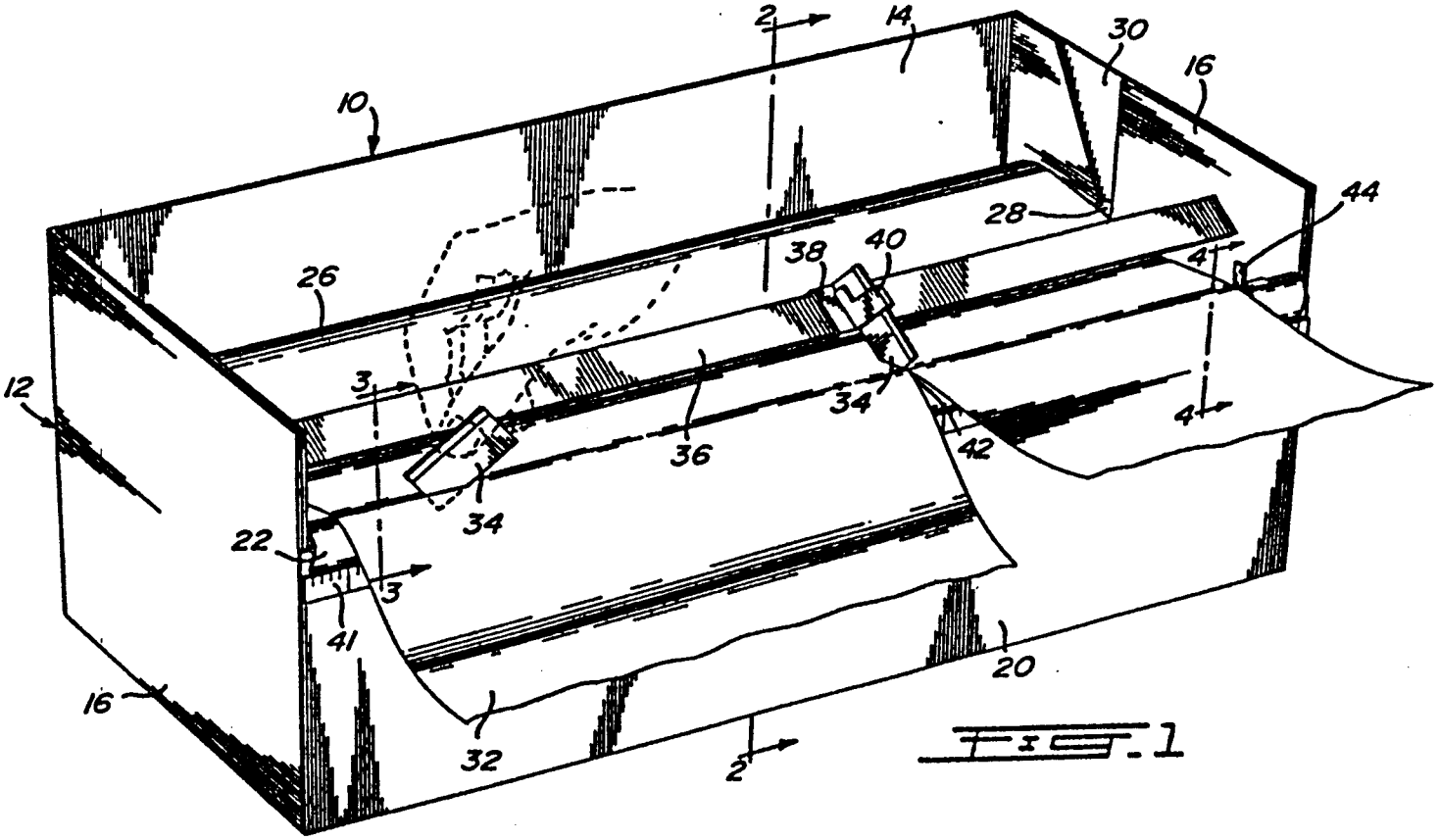
FIG. 1 is an isometric view showing an apparatus for cutting wall covering sheet according to one embodiment of the present invention.

Referring now to the drawings, the apparatus 10 for cutting wall covering sheet is formed of cardboard sheet folded into a container 12 with a back side 14 and two ends 16 together with a base 18. A front side 20 extends only partially for the same height as the backside 14 and has a transverse member 22 in the form of an H-shaped double slotted plastic extrusion which has one slot fitted over the top edge of the front side 20, the other slot 24 facing upwards is used to cut a sheet.

Figure 3:
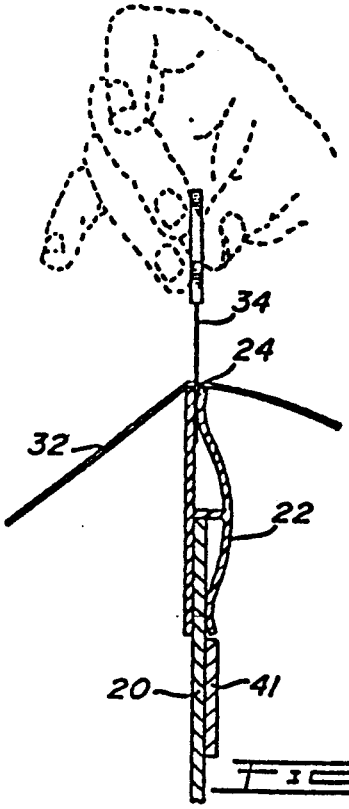
FIG. 3 is a partial cross sectional view taken at line 3—3 of FIG. 1.

A roll 26 of wall covering sheet is supported on a rod 28 extending across the container 12 and having two slots 30 cut on the inside of the end walls 16 to support the rod 28. The end walls are preferably formed of two layers of cardboard, thus the slot 30 is cut in the inside layer only. Sheet 32 from the roll 26 is pulled from the top of the roll 26 over the transverse member 22 and, as shown in FIG. 1 and FIG. 3, a cutting blade 34, which may be a simple razor blade cuts transversely across the sheet 32 by insertion into the cutting slot 24 of the transverse member 22.

In operation to make a transverse cut, a tape measure (not shown) may be used to measure a length of sheet 32 from the roll 26. The tab of the tape measure may be inserted into the cutting slot 24 of the transverse member 22 and extended out so that the sheet is measured for the correct length from the cutting slot 24. The cutting blade 34 is then used to cut the sheet 32 in the cutting slot 24 of the transverse member 22.

Figure 2:
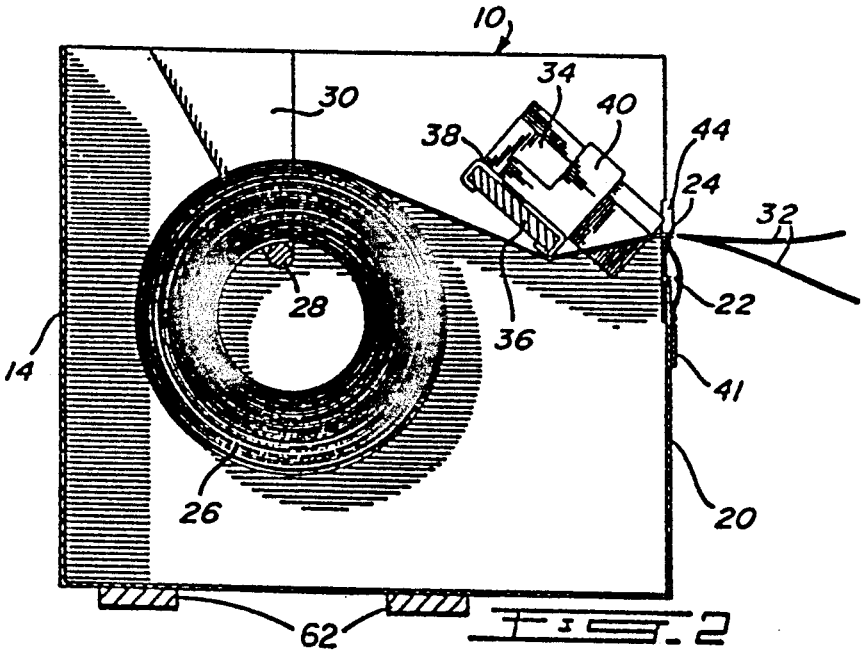
FIG. 2 is a cross sectional view taken at line 2—2 of FIG. 1.

A track member 36 as shown in FIGS. 1 and 2 extends from end to end of the container 12 and fits in apertures cut in the first layer at the two ends 16. The track 36 is positioned substantially parallel to the transverse member 22 and the roll 26. On this track 36 is a cutting blade holder 38 which can be slid laterally along the track 36. In the center of the holder 38 is a cutting blade support 40 for a cutting blade 34 which, as in the case of transverse cut, may be a razor blade. The cutting blade 34 can slide backwards and forwards in the blade support 40. The track 36 is positioned so that when the blade is pushed down, it cuts or slits the sheet 32. A plurality of blade holders 38 and supports 40 may be disposed along track 36 so as to enable a number of strips of sheet to be cut from the roll 26.

In operation, a scale 41 is attached to the front side 20 of the container 12 directly below the transverse member 22. The blade holder 38 is slid along the track 36 to set the dimension required on the scale 41 representing the width of sheet 32 to be cut, the blade 34 is pushed through the blade support 40 until it cuts the sheet 32 and the sheet is then pulled from the roll 26 making a longitudinal cut 42 which is at the dimension set on the scale 41.

Figure 4:
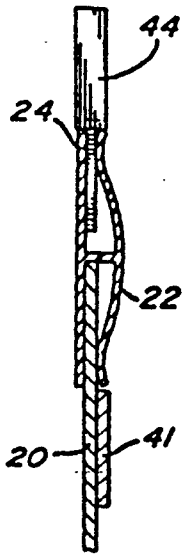
FIG. 4 is a partial cross sectional view taken at line 4—4 of FIG. 1.

A tab member 44 illustrated in FIGS. 1 and 4 is bent up to form a stop that becomes a side guide so that the edge of the sheet 32 rubs against the guide as it is being pulled from the roll 26, and this sets the exact width of the longitudinal cut 42.

The container 12 itself is preferably made from cardboard as stated, and is made so that it can be unfolded and laid out in a flat configuration. By using two layers for the ends 16, the slot 30 to support the rod 28 for the roll 26 is provided in the inside layer as well as the apertures to hold the track 36. Alternatively, the container 12 may be made from a plasticized cardboard or other waterproof material so that the container may be used to hold water. In this manner, a roll 26 of wall covering sheet may advantageously soak in the water retained by the said container, thereby allowing the soaked sheeting to be cut and to be applied immediately thereafter to a wall or other surface intended to be covered.

The container 12 may also have applied thereunder a plurality of double-sided adhesive foam pads 62 or the like for securing the container to a supporting surface. In this manner, the container is retained in place against the pulling forces extended thereon when a sheet 32 is being pulled out from the roll 26.

Figure 5:
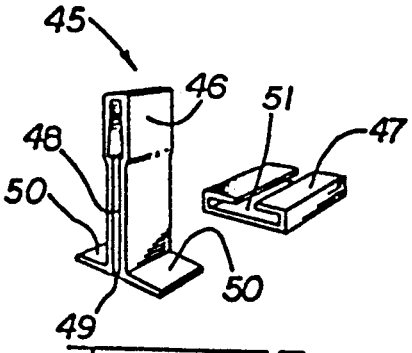
FIG. 5 is a perspective view showing a two-part blade holder according to a second embodiment of the present invention.
Figure 6:
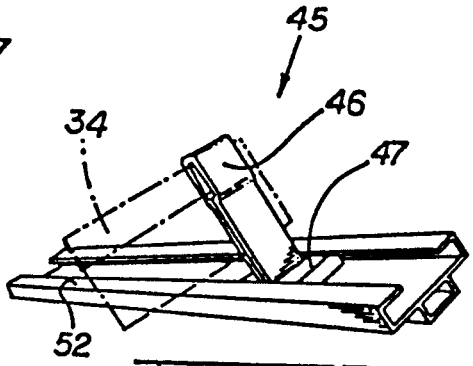
FIG. 6 is a perspective view of a track member for the blade holder of FIG. 5.

Referring now to FIGS. 5 and 6, the cutting blade holder 45 is provided in a two-part construction consisting of a clip member 46 and a base member 47 therefor. The clip member 46 provides a longitudinal slot 48 for retaining a cutting blade 34, said slot opening at the base 49 of said clip member. The base 49 of said clip member provides a pair of two outwardly projecting flanges 50, the flanges being adapted for intimate slip-fit engagement with a channel 51 provided in the base member 47.

When assembled, the two-part cutting blade holder 45 may be slidingly received in an elongate track member 52 which may be substituted for the track 36 described hereinabove. As is the case with the previously described cutting blade holder 38 and track 36, the holder 45 can be slid laterally along the track member 52 to set the required dimension of sheet to be cut. It is to be understood that a plurality of blade holders 45 may be disposed in the track member 52, for instance, where it is desired to cut a number of strips of sheet from the roll 26.

Figure 8:
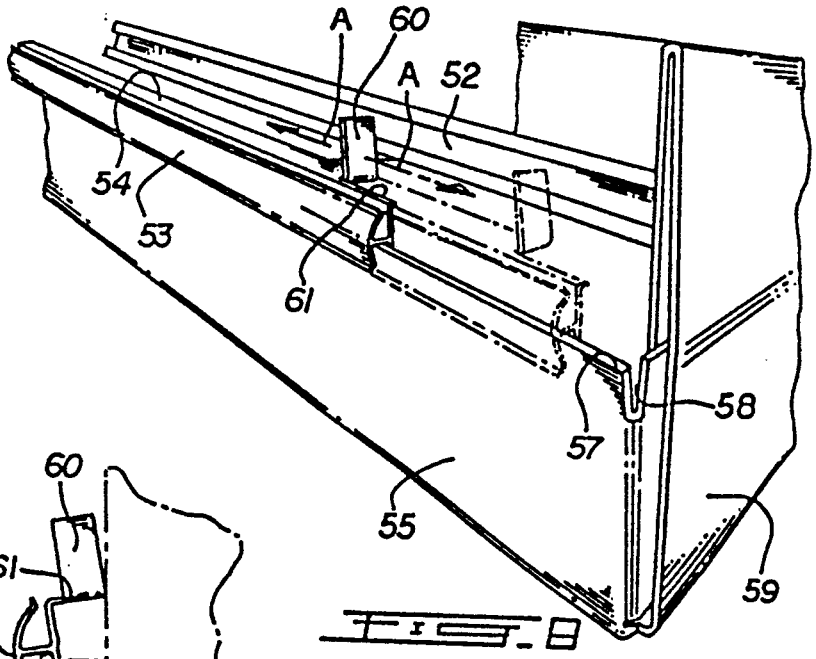
FIG. 8 is a partial perspective view of an apparatus for cutting wall covering sheet showing the transverse member of FIG. 7 in operation.
Figure 7:
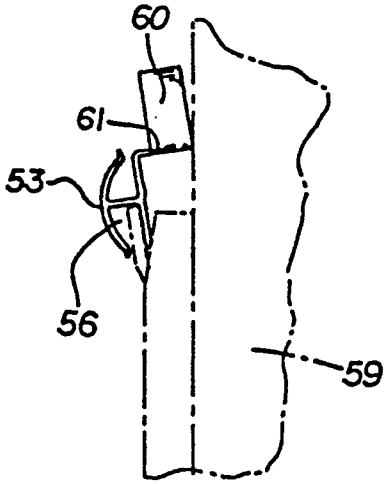
FIG. 7 is an end view of a transverse member according to a third embodiment of the present invention.

Referring now to FIGS. 7 and 8, an alternative transverse member 53 is provided in the form of an H-shaped double-slotted extrusion as previously described, but further having a flange portion 54 which extends inwardly into the container 12. The flange portion 54 of member 53 is intended to prevent a cut sheet of wall covering from falling into the container.

Transverse member 53 has a lower slot 56 which is fitted over the leading edge 57 of the front side 55 of the container box, the front side being separated from the sides 59 of the container to thereby form openings 58 at each terminal end of the front side 55 of the container. The openings 58 permit the transverse member 53 to slide laterally along leading edge 57 in the direction of arrows "A". A tab 60 is provided at the end of transverse member 53. The tab 60 is preferably integral to member 53 and is formed by cutting a slit into member 53 as at 61 and bending upwardly the terminal end of flange portion 54 thereof. In this manner, the whole of member 53 may be laterally slid as described so that tab 60 acts as a side guide for the edge of the sheet to be cut.

Various changes may be made to the embodiments described herein without departing from the scope of the invention which is limited only by the following claims.

The embodiments of the invention in which an exclusive property or privilege is claimed are defined as follows:

1. An apparatus for cutting wall covering sheet transversely and longitudinally from a roll, said apparatus comprising:

a container having a rod positioned in slots on opposing inside ends of the container, the rod constituting means to hold a roll of wall covering sheet and allow the sheet to be unwound;

a cutting blade;

a transverse member on an edge of one side of the container positioned substantially parallel with the roll, the sheet passing over the transverse member when unwound from the roll, the transverse member having a slot therein extending along a longitudinal axis thereof, said slot constituting a guide for said cutting blade to make a transverse cut in the sheet, said transverse member comprising a fixed tab adjacent one end thereof, said transverse member being integrally moveable laterally along the said edge of the container so that said fixed tab thereof acts as a guide for an edge of sheet unwound from the roll;

a longitudinal track member in the container supported on the opposing inside ends of the container, and extending transversely substantially parallel to the roll and the transverse member, and disposed therebetween, the longitudinal track member providing a guide to deflect the sheet downwards for the sheet to pass thereunder when unwound from the roll and passing over the transverse member; and a cutting blade holder slidingly mounted on the longitudinal track member for positioning at any location thereon, said cutting blade being mounted in said cutting blade holder to cut the sheet longitudinally after passing under the longitudinal track member, and before passing over the transverse member, the said cutting blade being removable from said cutting blade holder and constituting means for making said transverse cut in said sheet by sliding engagement of said blade in the slot of said transverse member.

2. The apparatus according to claim 1, wherein the container is made of foldable cardboard.

3. The apparatus according to claim 2, wherein the transverse member is an H-shaped double slotted plastic extrusion, one slot fitting over one side of the container and the other slot for the cutting blade.

4. The apparatus according to claim 2, including a scale on the container to measure the location of the cutting blade holder on the longitudinal track member.

5. The apparatus according to claim 1, wherein said container is composed of waterproof material and constitutes means for holding water for soaking said wall covering sheet.

6. The apparatus according to claim 1, wherein openings are provided in said container adjacent the terminal ends of said transverse member to thereby enable said member to slide laterally along the said edge of the container.

7. The apparatus according to claim 6, wherein said transverse member comprises a flange which is inwardly disposed of the said container.

8. The apparatus according to claim 7, wherein said fixed tab is integral to said transverse member and is formed by upwardly bending a terminal portion of said flange thereof.

9. The apparatus according to claim 1, wherein adhesive means are provided on said container for securing said container to a supporting surface therefor.

10. The apparatus according to claim 9, wherein said adhesive means constitutes a double-sided adhesive foam pad applied to the undersurface of said container.

11. An apparatus for cutting a wall covering sheet transversely and longitudinally from a roll, said apparatus comprising:

a container having a rod means positioned in slots on opposing inside ends of the container for holding a roll of wall covering sheet and allowing the sheet to be unwound;

a cutting blade;

a transverse member on an edge of one side of the container positioned substantially parallel with the roll, the sheet passing over the transverse member when unwound from the roll, the transverse member having a slot therein extending along a longitudinal axis thereof for guiding said cutting blade to make a transverse cut in the sheet;

a longitudinal track member in the container supported on the opposing inside ends of the container, and extending transversely substantially parallel to the roll and the transverse member, and disposed therebetween, the longitudinal track member providing a guide to deflect the sheet downwards for the sheet to pass thereunder when unwound from the roll and passing over the transverse member; and, a cutting blade holder slidingly mounted on the longitudinal track member for positioning at any location thereon, said cutting blade being mounted in said cutting blade holder to cut the sheet longitudinally after passing under the longitudinal track member, and before passing over the transverse member.

* * * * *